US011559143B2

(12) United States Patent
Khambete

(10) Patent No.: US 11,559,143 B2
(45) Date of Patent: Jan. 24, 2023

(54) NON-SEWN MATTRESS AND METHOD OF MANUFACTURING THEREOF

(71) Applicant: Indratech LLC, Troy, MI (US)

(72) Inventor: Surendra Khambete, Bloomfield Hills, MI (US)

(73) Assignee: IndraTech LLC, Troy, MI (US)

( * ) Notice: Subject to any disclaimer, the term of this patent is extended or adjusted under 35 U.S.C. 154(b) by 40 days.

(21) Appl. No.: 17/126,278

(22) Filed: Dec. 18, 2020

(65) Prior Publication Data

US 2021/0186229 A1 Jun. 24, 2021

Related U.S. Application Data

(60) Provisional application No. 62/951,698, filed on Dec. 20, 2019.

(51) Int. Cl.

| | |
|---|---|
| ***A47C 31/02*** | (2006.01) |
| ***A47C 21/04*** | (2006.01) |
| ***A47C 31/00*** | (2006.01) |
| ***A47C 27/12*** | (2006.01) |

(52) U.S. Cl.

CPC ..... *A47C 31/02* (2013.01); *A47C 21/044* (2013.01); *A47C 27/121* (2013.01); *A47C 27/127* (2013.01); *A47C 31/001* (2013.01)

(58) Field of Classification Search

CPC ..... A47C 31/00; A47C 31/02; A47C 27/121; A47C 27/127; A47C 31/001; A47C 21/044; A47C 27/002

See application file for complete search history.

(56) References Cited

U.S. PATENT DOCUMENTS

| | | | | |
|---|---|---|---|---|
| 2005/0095936 | A1* | 5/2005 | Jones | B32B 5/26 428/920 |
| 2007/0256246 | A1* | 11/2007 | Gladney | A47C 27/002 5/691 |
| 2014/0075678 | A1* | 3/2014 | Murphy | A47C 27/056 5/698 |
| 2016/0345745 | A1* | 12/2016 | Zoltan | A47C 27/122 |

* cited by examiner

*Primary Examiner* — Fredrick C Conley

(74) *Attorney, Agent, or Firm* — Harness, Dickey & Pierce, P.L.C.

(57) ABSTRACT

A method of manufacturing a mattress that comprises forming a mattress inner core; forming a non-quilted mattress cover; and attaching the non-quilted mattress cover to the inner core without sewing. The non-quilted mattress cover may be formed of a laminate including a polymeric non-woven fabric that may be embossed and cut to include a cover top panel and a plurality of cover side panels that are unitary with and extend outward from the cover top panel. The step of attaching the non-quilted mattress cover to the inner core without sewing includes orthogonally orienting the cover side panels relative to the cover top panel and fusing portions of adjoining surfaces of adjacent cover side panels to each other to form a coffin, inserting the mattress inner core into the coffin, folding non-fused portions of the adjoining surface of the adjacent cover side panels over the mattress inner core, and bonding a bottom panel to the non-fused portions of the cover side panels and the mattress inner core.

27 Claims, 5 Drawing Sheets

NON-SEWN MATTRESS AND METHOD OF MANUFACTURING THEREOF

CROSS-REFERENCE TO RELATED APPLICATIONS

This application claims the benefit of U.S. Provisional Application No. 62/951,698, filed on Dec. 20, 2019. The entire disclosure of the above application is incorporated herein by reference.

FIELD

The present disclosure relates to a non-sewn mattress and method of manufacturing thereof.

BACKGROUND

This section provides background information related to the present disclosure which is not necessarily prior art.

Conventional mattresses generally have a fabric cover, and sometimes a comfort layer formed of fabric. In addition, conventional mattresses generally include a core that may include an inner coil spring unit surrounded by polyurethane rails around the perimeter of the mattress, and surrounded on the top and bottom by padding which provides a barrier and cushion against the metal springs. In better quality mattresses a wire grid may further be provided as a barrier between the padding and the spring unit. The padding is then padded on its top and bottom by layers of polyurethane foam, cotton, and other materials. The typical outer construction of a mattress includes a top and bottom cover, and a border which surrounds the four sides or perimeter of the spring unit. The covers and border are usually quilted fabric available in a variety of colors and print patterns, thus providing the initial aesthetic appeal to the customer.

The covers and borders are typically permanently attached to the mattress core with a closing machine that permanently seals the mattress. The closing machine sews the covers and borders to the mattress core, which requires hundreds of needles that regularly break and need to be repaired, which can cause undesirable maintenance downtime. In addition, sewing of the covers and borders to the mattress core can take a long period of time, which is undesirable from a productivity standpoint.

What's more, the polyurethane of a conventional mattress is not a material that can be recycled.

SUMMARY

This section provides a general summary of the disclosure, and is not a comprehensive disclosure of its full scope or all of its features.

According to a first aspect of the present disclosure, there is provided a method of manufacturing a mattress that comprises forming a mattress inner core; forming a non-quilted mattress cover; and attaching the non-quilted mattress cover to the inner core without sewing. The non-quilted mattress cover may be formed of a laminate including a polymeric non-woven fabric that may be embossed and cut to include a cover top panel and a plurality of cover side panels that are unitary with and extend outward from the cover top panel. The step of attaching the non-quilted mattress cover to the inner core without sewing includes orthogonally orienting the cover side panels relative to the cover top panel and fusing portions of adjoining surfaces of adjacent cover side panels to each other to form a coffin, inserting the mattress inner core into the coffin, folding non-fused portions of the adjoining surface of the adjacent cover side panels over the mattress inner core, and bonding a bottom panel to the non-fused portions of the cover side panels and the mattress inner core.

According to the first aspect of the present disclosure, the mattress inner core may be formed from least one layer of polymeric nonwoven fiber.

According to the first aspect of the present disclosure, the mattress inner core may be formed from a plurality of layers of polymeric nonwoven fiber, and each of the plurality of layers include a different density of the nonwoven fibers to adjust a stiffness of the mattress inner core.

According to the first aspect of the present disclosure, the plurality of layers of polymeric nonwoven fiber may be stacked on top of each other.

According to the first aspect of the present disclosure, the plurality of layers of polymeric nonwoven fiber may be stacked side-by-side relative to each other.

According to the first aspect of the present disclosure, the method may further comprise adhering a rail assembly to the mattress inner core about a perimeter of the mattress inner core.

According to the first aspect of the present disclosure, a stiffness of the rail assembly may be adjusted by applying a rigid coating to the rail assembly.

According to the first aspect of the present disclosure, the polymeric non-woven fabric may be formed of a recyclable polymeric material.

According to the first aspect of the present disclosure, the recyclable polymeric material may be at least one of polyester and polyethylene.

According to the first aspect of the present disclosure, the laminate may include a fiber layer.

According to the first aspect of the present disclosure, the fiber layer may be fire-retardant.

According to the first aspect of the present disclosure, the portions of the adjoining surfaces of the adjacent cover side panels may be fused to each other using RF or ultrasonic welding.

Lastly, according to the first aspect of the present disclosure, the laminate may be embossed by heated stamping.

According to a second aspect of the present disclosure, there is provided a mattress, comprising a mattress inner core; a non-quilted mattress cover that is attached to the mattress inner core without sewing; and a bottom panel that is attached to the inner core and non-quilted mattress cover without sewing. The non-quilted mattress cover may be formed of a laminate including a polymeric non-woven fabric that is embossed, and may include a cover top panel and a plurality of cover side panels that are unitary with and extend outward from the cover top panel. The cover side panels are orthogonally oriented relative to the top panel, and adjoining surfaces of adjacent cover side panels include fused portions that are fused together and surround the mattress inner core, and non-fused portions that are not fused together and are folded over the mattress inner core. The bottom panel may be adhered to the non-fused portions folded over the mattress inner core and to the mattress inner core.

According to the second aspect of the present disclosure, the mattress inner core may be formed from least one layer of polymeric nonwoven fiber.

According to the second aspect of the present disclosure, the mattress inner core may be formed from a plurality of layers of polymeric nonwoven fiber, and each of the plurality of layers may include a different density of the nonwoven fibers to adjust a stiffness of the mattress inner core.

According to the second aspect of the present disclosure, the plurality of layers of polymeric nonwoven fiber may be stacked on top of each other.

According to the second aspect of the present disclosure, the plurality of layers of polymeric nonwoven fiber may be stacked side-by-side relative to each other.

According to the second aspect of the present disclosure, the mattress may also include a rail assembly adhered to the mattress inner core about a perimeter of the mattress inner core.

According to the second aspect of the present disclosure, the rail assembly may include a rigid coating.

According to the second aspect of the present disclosure, the polymeric non-woven fabric may be formed of a recyclable polymeric material.

According to the second aspect of the present disclosure, the recyclable polymeric material may be at least one of polyester and polyethylene.

According to the second aspect of the present disclosure, the laminate may include a fiber layer.

Lastly, according to the second aspect of the present disclosure, the fiber layer may be fire-retardant.

Further areas of applicability will become apparent from the description provided herein. The description and specific examples in this summary are intended for purposes of illustration only and are not intended to limit the scope of the present disclosure.

DRAWINGS

The drawings described herein are for illustrative purposes only of selected embodiments and not all possible implementations, and are not intended to limit the scope of the present disclosure.

Corresponding reference numerals indicate corresponding parts throughout the several views of the drawings.

DETAILED DESCRIPTION

Example embodiments will now be described more fully with reference to the accompanying drawings. The example embodiments are provided so that this disclosure will be thorough, and will fully convey the scope to those who are skilled in the art. Numerous specific details are set forth such as examples of specific components, devices, and methods, to provide a thorough understanding of embodiments of the present disclosure. It will be apparent to those skilled in the art that specific details need not be employed, that example embodiments may be embodied in many different forms and that neither should be construed to limit the scope of the disclosure. In some example embodiments, well-known processes, well-known device structures, and well-known technologies are not described in detail.

Figure 1:
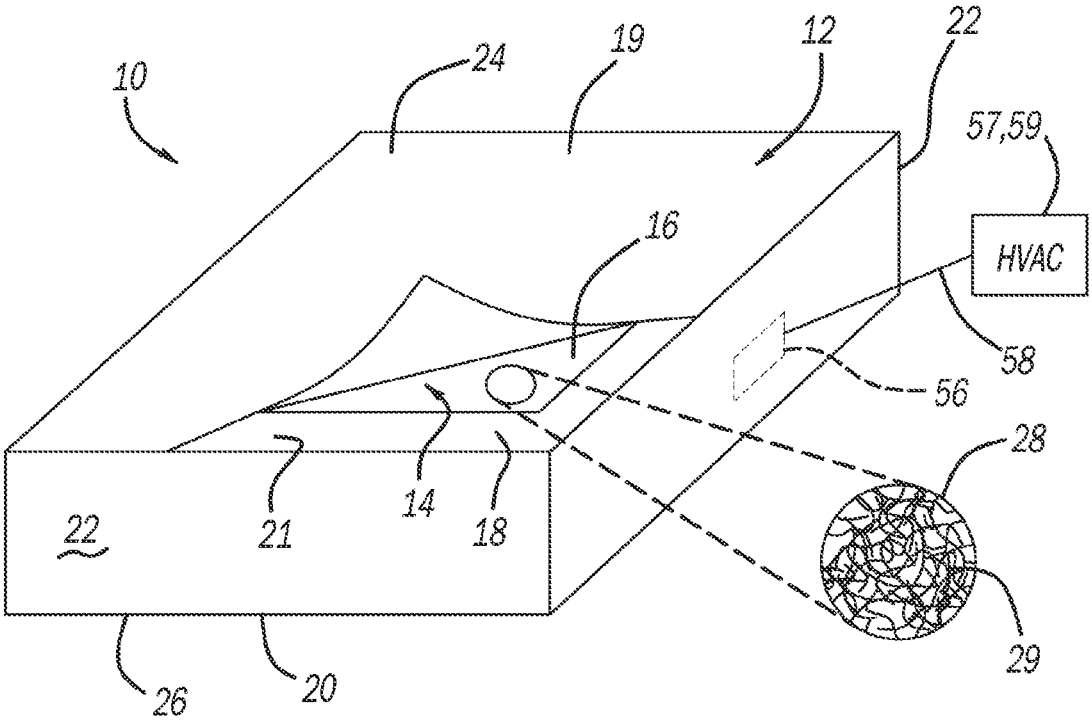
FIG. 1 is a perspective view of a mattress according to a principle of the present disclosure.

Referring to FIG. 1, the present disclosure provides a mattress 10 having a non-quilted cover 12. A portion of non-quilted cover 12 is peeled back in FIG. 1 to reveal that mattress 10 has a core assembly 14 including an inner core 16 and an optional rail assembly 18 positioned about a perimeter of the inner core 16. Core assembly 14 is surrounded on the top 19, bottom 20, and side surfaces 22 thereof by non-quilted cover 12. As will be discussed in more detail below, non-quilted cover 12 includes a first panel 24 and a second panel 26 that seal core assembly 14, and are attached to each other in a non-sewn manner.

Inner core 16 of core assembly 14 may be formed of at least one tunable layer 28 of randomly oriented nonwoven fibers 29. The nonwoven fibers 29 are preferably formed of a polymeric material such as polyester, polyethylene, or a combination thereof. It should be understood, however, that other thermoplastic polyolefins, polymer, or thermoplastic materials known to those skilled in the art are contemplated. Because the nonwoven fibers 29 are formed of at least one of the above-noted polymeric materials, inner core 16 is entirely recyclable and does not require the use of metal springs like a conventional mattress. In addition, the use of polymeric nonwoven fibers 29 in lieu of metal springs surrounded by natural fibers of a quilted cover is beneficial in that inner core 16 will not retain moisture or liquids so that inner core 16 is mold and mildew resistant, breathable, can be washed, and is hypoallergenic. Further, the nonwoven fibers 29 of inner core 16 allow for reduced heat retention due to air circulation through gaps between the nonwoven fibers.

Figure 2:
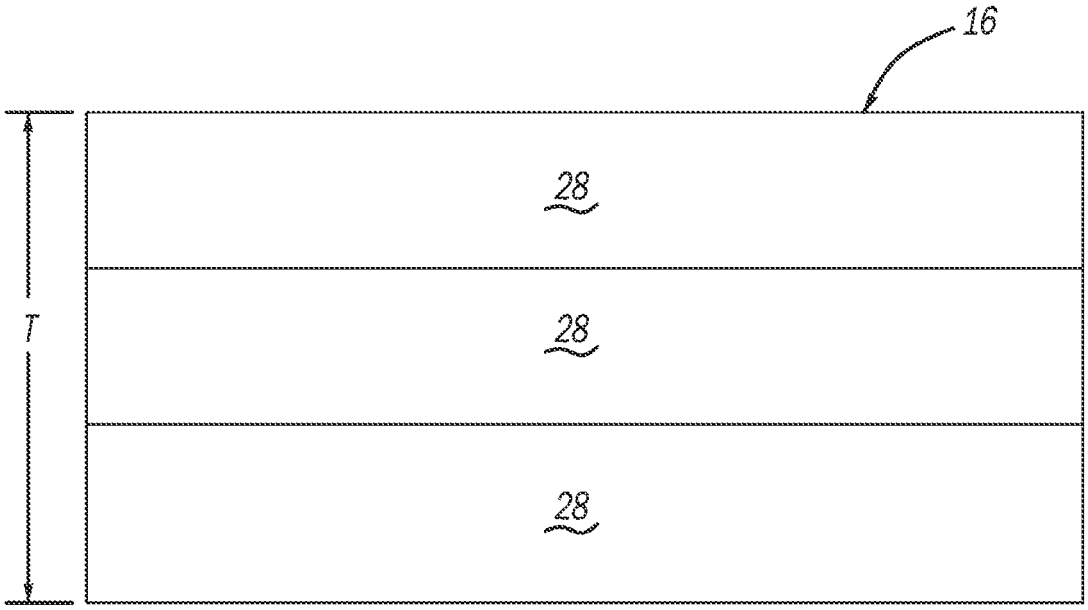
FIG. 2 is a side view of an example inner core of the mattress illustrated in FIG. 1.

Layer 28 is "tunable" in that a density of the nonwoven fibers 29 can be selected based on the desired stiffness of the inner core 16. Although inner core 16 only requires a single layer 28, it should be understood that a plurality of layers 28 can be stacked upon one another in a thickness direction T of the inner core 16, if desired, as shown in FIG. 2. In such a configuration, the different layers 28 may each be formed of the same material (e.g., polyester or polyethylene), or the different layers 28 can be formed of different materials (e.g., layer(s) of polyester and layer(s) of polyethylene). It is also contemplated that the different layers 28 can have different densities to further allow variable tuning of the inner core 16. Although three layers 28 are illustrated in FIG. 2, a greater or lesser number of layers 28 is contemplated. The "density" of the nonwoven fibers 29 can be adjusted by increasing or decreasing an amount of the nonwoven fibers 29 per unit volume, or by increasing or decreasing the thickness (e.g., diameter) or molecular weight of each respective nonwoven fiber 29.

Figure 3:
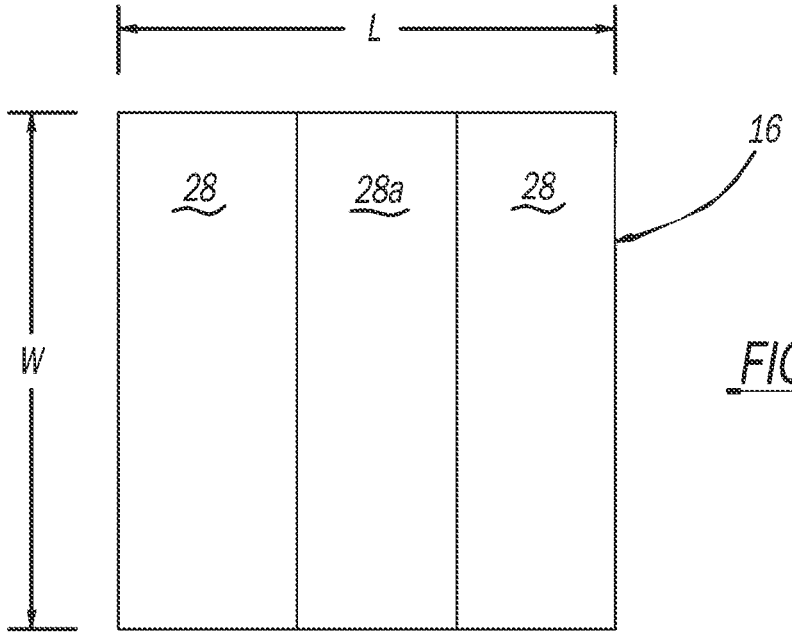
FIG. 3 is a top view of another example inner core of the mattress illustrated in FIG. 1.

Alternatively, as shown in FIG. 3, inner core 16 can include a plurality of layers 28 that are arranged side-by-side in either a width W or length L direction of inner core 16. In FIG. 3, the layers 28 are arranged side-by-side in the length direction L. In either configuration, the different layers 28 may each be formed of the same material (e.g., polyester or polyethylene), or the different layers 28 can be formed of different materials (e.g., layer(s) of polyester and layer(s) of polyethylene). It is also contemplated that the different layers 28 can have different densities to further allow variable tuning of the inner core 16. For example, a higher-density layer 28*a* can be located at a location of the inner core 16 that corresponds to providing increased lumbar support. Although three layers 28 are illustrated in FIG. 3, a greater or lesser number of layers 28 is contemplated.

Figure 4:
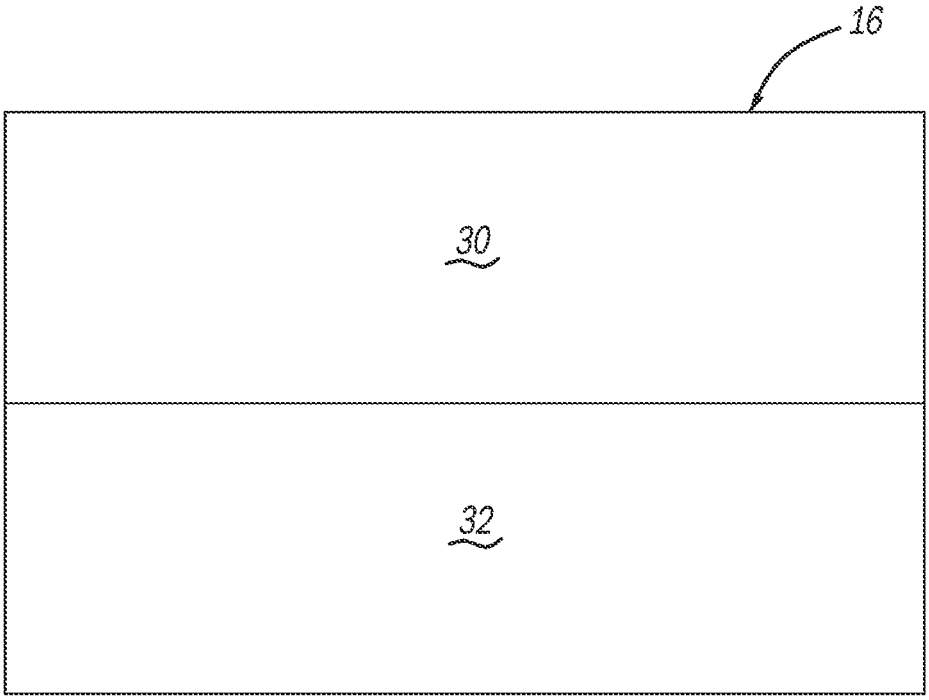
FIG. 4 is a top view of an inner core of the mattress illustrated in FIG. 1.

In addition, in larger mattress sizes such as queen- and king-sized mattresses, the densities of the nonwoven layer(s) 28 of the inner core 16 can be varied on opposing sections 30 and 32 (i.e., the left and right sides of the mattress 10, see FIG. 4) of the mattress 10 such that a person that desires a stiffer section (e.g., at 30) of the mattress can have layer(s) 28 selected to provide the increased stiffness, while another person that desires a less stiff section (e.g., at 32) of the mattress can have layer(s) 28 selected to provide the lower stiffness. It is also contemplated that regardless of the stiffness of each section 30 and 32, a respective section 30 or 32 may or may not include a higher-density layer 28*a* that corresponds to providing increased lumbar support. Further, although only two sections 30 and 32 are illustrated, it should be understood that mattress 10 can have a greater number of tunable sections, as desired.

If mattress 10 includes a rail assembly 18, it should be understood that rail assembly 18 can also be formed of nonwoven fibers 29 but at an increased density to provide the stiffness required. Rail assembly 18 may be attached to inner core 16 by an adhesive, by bonding with heat, or any other attachment method known to one skilled in the art. The increased density rail assembly 18 may be desirable from the standpoint that rail assembly 18 provides additional support for a person to sit on the edge of mattress 10, as well as maintaining a proper configuration of mattress 10 over time. In some embodiments, rail assembly 18 may be formed of a lower density nonwoven fiber 29, and then reinforced to provide the increased stiffness necessary. To reinforce the rail assembly 18, the nonwoven fibers 29 can be provided with a sprayed-on coating 21 that forms a hard shell around the exterior of the rail assembly 18. Coating 21 may be formed of a polymeric material such as polyethylene, or any other type of polymeric material known to one skilled in the art that can provide increased rigidity to rail assembly 18. It should be understood, however, that the present disclosure should not be limited to spraying on the coating 21 and other methods of applying the coating 21 such as dipping, roll-coating, and the like are contemplated.

Figure 5:
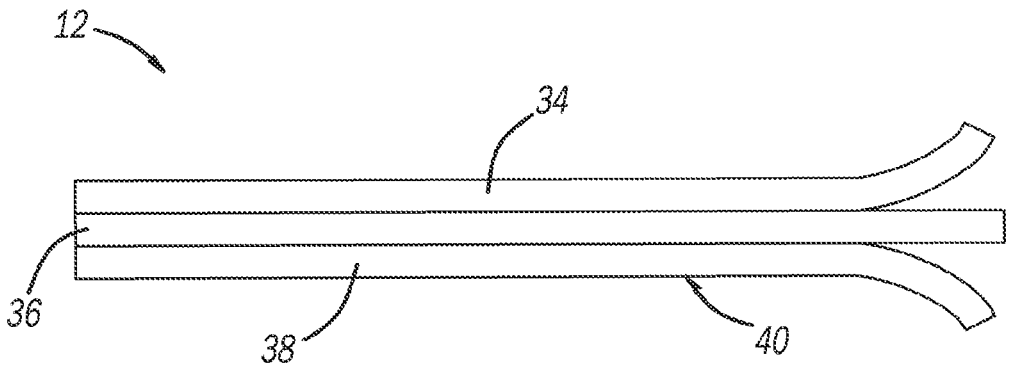
FIG. 5 is a side view of a portion of a non-quilted cover according to a principle of the present disclosure.

As shown in FIG. 5, non-quilted cover 12 may also be formed of at least one layer 34 of nonwoven fibers 29 formed of polyethylene and/or polyester. Non-quilted cover 12 may also include at least one fiber layer 36 that may be fire retardant. Optionally, non-quilted cover 12 can include at least one fiber layer 36, and at least one fire retardant layer 38. In any case, the layer(s) 34 of nonwoven fibers 29, layer(s) of fiber 36, and fire-retardant layer(s) 38 are laminated to fuse the layers 34, 36, and 38 together. The layers 34, 36, and 38 may be fused together by a heat-activated adhesive along with applying pressure to the laminate to mold the non-quilted cover 12 to the desired thickness. Because non-quilted cover 12 includes at least one layer 34 of nonwoven fibers, it should be understood that the feel and density of non-quilted cover 12 is tunable in a manner similar to inner core 16.

After lamination, non-quilted cover 12 may be heat embossed. Embossing is a process of stamping an aesthetic pattern onto the non-quilted cover 12. In the present embodiment, the polymeric nonwoven fiber layer 34 is stamped using a heated stamper that heats the nonwoven fiber layer 34 to melt the polymers of the nonwoven fiber and impart the aesthetic pattern of the heated stamper. This process provides a more permanent and defined appearance to non-quilted cover 12. It should also be understood that there many advantages to heat embossing non-quilted cover rather than sewing a conventional quilted cover. In particular, embossing non-quilted cover 12 only requires a dwell time of about 30 seconds, while sewing a conventional quilted cover can take up to ten times longer. In addition, embossing only requires one die (stamper) that ensures consistency amongst multiple non-quilted covers 12 because the same stamp is used to make each non-quilted cover 12. In contrast, sewing a conventional quilted requires hundreds of needles that regularly break, which can decrease the consistency amongst multiple conventional quilted covers. Broken needles also require cause maintenance downtime, which negatively affects productivity in producing a conventional mattress.

Now, a method of assembly mattress 10 will be described. During the following description of assembling the mattress 10, it should be understood that inner core 16 has already been manufactured according to the customer's desired features, including tuning the stiffness of the inner core 16 by adjusting a density of the layer(s) 28 of the inner core 16. In addition, if rail assembly 18 is to be included as part of core assembly 14, it should be understood that rail assembly 18 has been attached to inner core 16.

After these elements have been manufactured, non-quilted cover 12 is manufactured according to the following steps. Firstly, as shown in FIG. 5, the various layers 34, 36, and 38 of non-quilted cover 12 are laminated together to the desired thickness to form a laminate 40. The thickness of the laminate 40 may range between 0.25 to 2.0 inches. In addition, a thickness of nonwoven layer 34 may also range between 0.25 to 2.0 inches. It should be understood, therefore, that nonwoven layer 34 may be used for non-quilted cover without layers 36 and 38.

Figure 6:
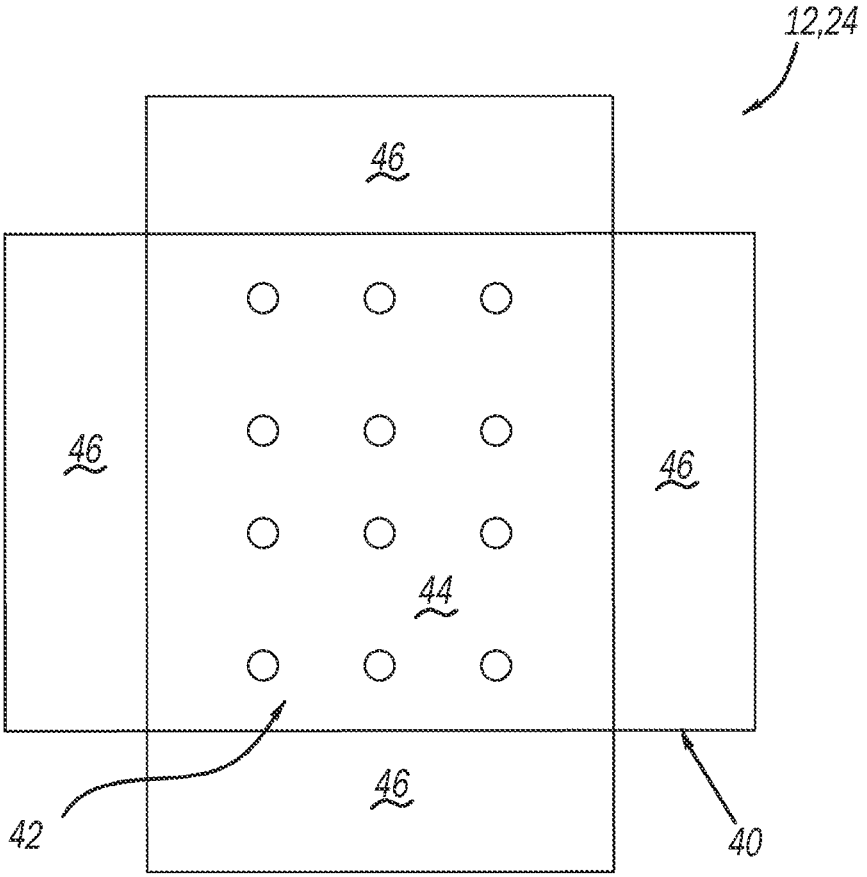
FIG. 6 is a top view of a non-quilted cover according to a principle of the present disclosure.

Secondly, as shown in FIG. 6, the laminate 40 is cut to the desired length and then subjected to a die cutting process that trims corner portions from the laminate 40 to yield a non-quilted cover 12 having a top panel 44 and a plurality of side panels 46 extending outward from top panel 44.

Thirdly, the trimmed laminate 40 is subjected to a heated embossing process to impart an aesthetic appearance 42 to at least top panel 44. It should be understood, however, that side panels 46 may also be embossed without departing from the scope of the present disclosure.

Figure 7:
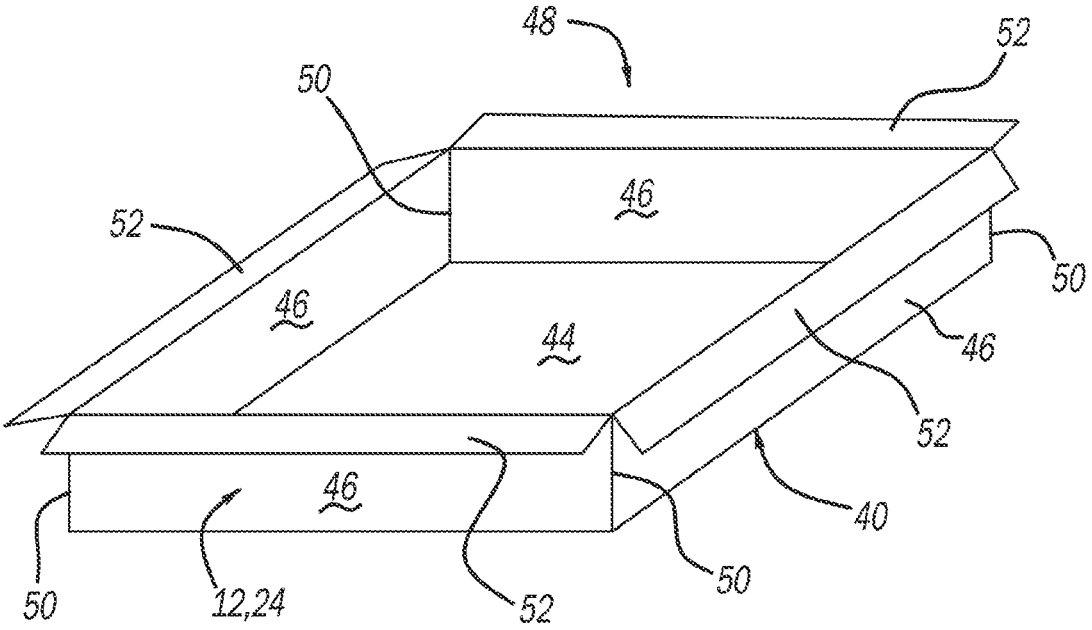
FIG. 7 is a perspective view of the non-quilted cover illustrated in FIG. 6, formed into a coffin.

Fourthly, as shown in FIG. 7, the trimmed and embossed laminate 42 is formed into a coffin 48. Coffin 48 is formed by orienting each side panel 46 orthogonally relative to top panel 44, and then sealing adjoining surfaces 50 of the adjacent side panels 46. To seal the adjoining surfaces 50, an RF or ultrasonic welding device (not shown) can be used to fuse the adjoining surfaces 50 together. When the adjoining surfaces 50 are joined, it should be understood that portions 52 of each side panel 46 are not fused to an adjacent adjoining surface 50 of an adjacent side panel 46. A width of each portion 52 that is not fused is about six to eight inches. The non-fused portions 52 are necessary as will be further described below.

Figure 8:
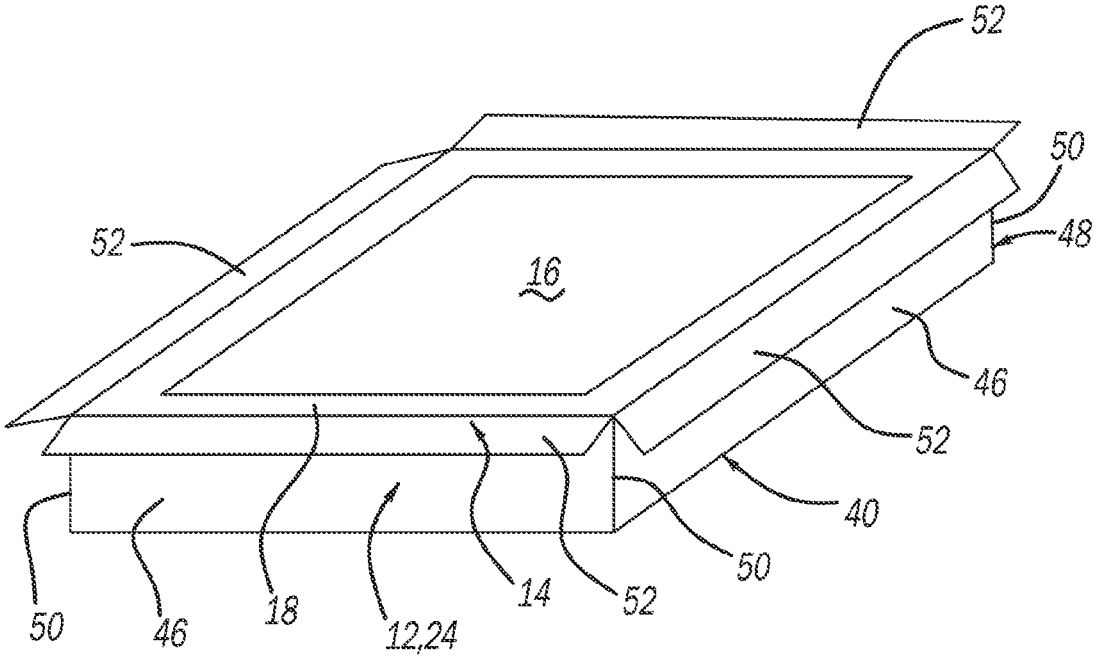
FIG. 8 is a perspective view of the coffin of FIG. 7, with a core assembly of the mattress inserted therein.
Figure 9:
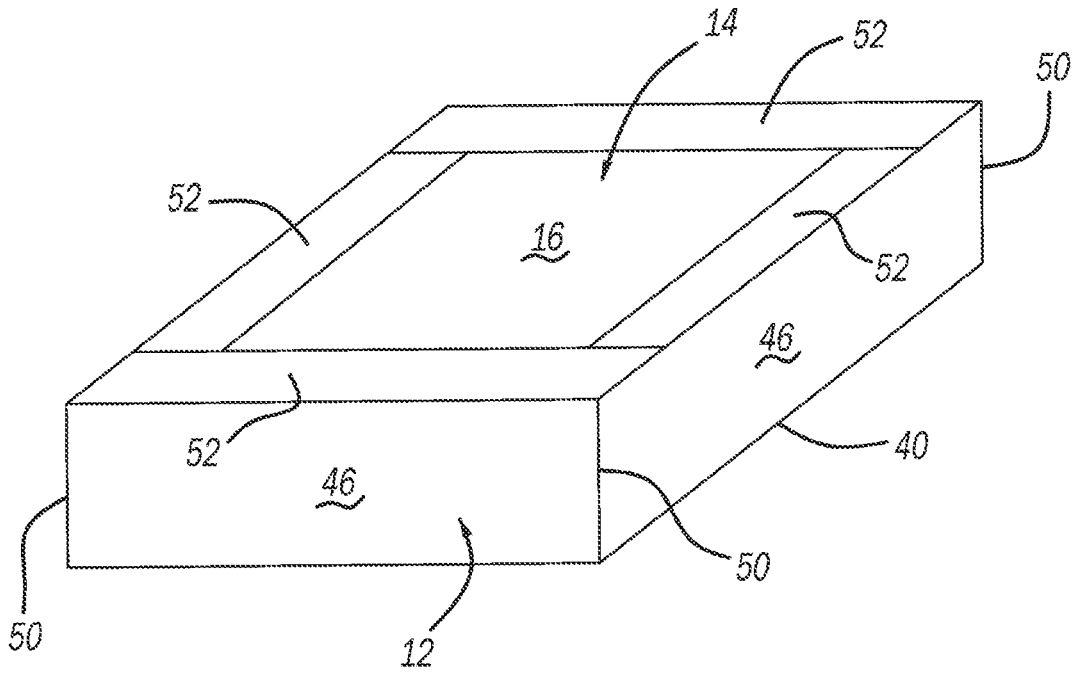
FIG. 9 is a perspective view of the coffin of FIG. 8, with non-fused portions of the side panels of the non-quilted cover folded over the inserted core assembly.

Fifthly, as shown in FIG. 8, once the adjoining surfaces 50 have been sealed, the core assembly 14 including inner core 16 and rail assembly 18 (if necessary) is inserted into coffin 48 upside down. That is, the surface of core assembly 18 upon which a person would lay is interfaced with top panel 44. Then, as shown in FIG. 9, the portions 52 of each side panel 46 that are not fused to an adjacent side panel 46 is folder over the bottom of the core assembly 14.

Figure 10:
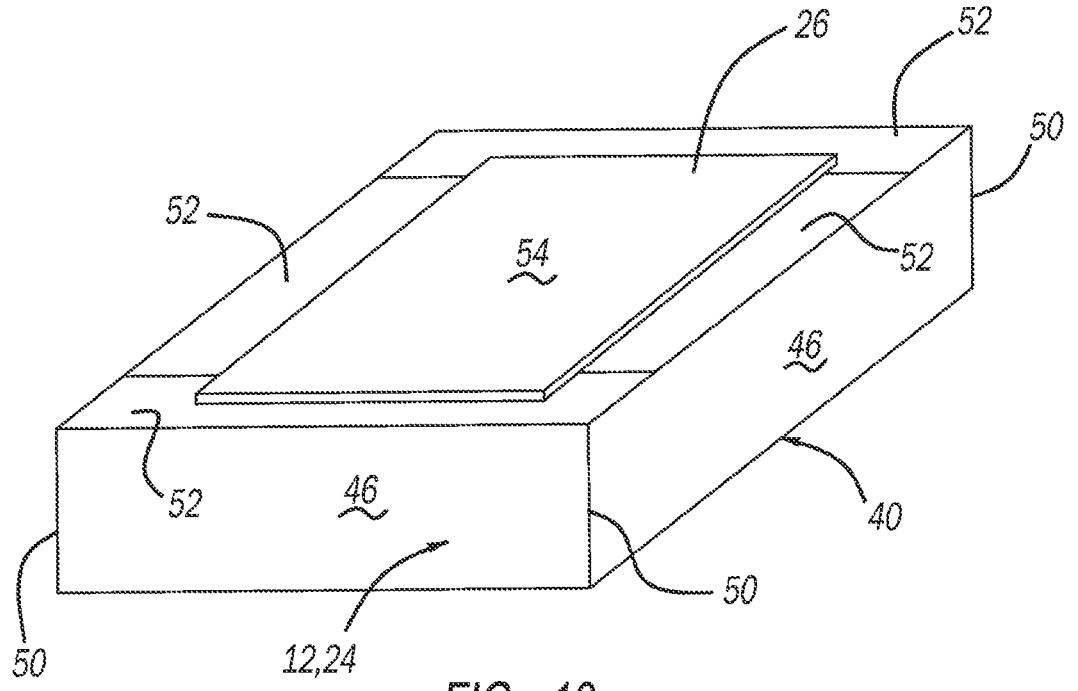
FIG. 10 is a perspective view of the coffin illustrated in FIG. 8, with a bottom panel of the non-quilted cover adhered to the non-fused portions of the side panels and the inserted core assembly.

Lastly, as shown in FIG. 10, a separately cut bottom panel 54 is placed over the core assembly 14 and portions 52 of each side panel 46 that are folded over core assembly 14. Bottom panel 54 may be formed of fabric or nonwoven fiber material. In any event, bottom panel 54 includes a heat activated adhesive on a surface thereof that is interfaced with core assembly 14 and portions 52. By applying heat with a heated panel (not shown) to bottom panel 54, bottom panel 54 will adhere to portions 52 and core assembly 14 to complete manufacture of mattress 10.

According to the above description, a tunable mattress 10 can be provided that does not require sewing in any step of the manufacturing process. Mattress 10, therefore, can be manufactured in a much smaller time period in comparison to a conventional mattress that is manufactured by sewing. Moreover, to the extent that mattress is formed of a core assembly 14 and non-quilted cover 12 that are formed of polymeric materials, mattress 10 can easily be shredded and recycled when mattress 10 has reach the end of it useful life.

Although not required, it should be understood that mattress 10 can have an inlet port 56 formed either in a side surface of the mattress 10, or in a bottom surface of the mattress 10. Inlet port 56 may communicate with a separate heating/cooling device 57 by a hose 58 that can provided heated or cooled air into mattress 10, which allows mattress to be heated or cooled as desired. Alternatively, hose 58 can provide fluid communication between a HVAC vent 59 formed in a wall or floor of a room that houses mattress 10. As noted above, the nonwoven fibers of inner core 16 allow for air circulation through gaps between the nonwoven fibers. Thus, by forming inlet port 56 in mattress 10 that may provide mattress with heated or cooled air flow, mattress 10 can further be tuned for the customer's increased comfort.

The foregoing description of the embodiments has been provided for purposes of illustration and description. It is not intended to be exhaustive or to limit the disclosure. Individual elements or features of a particular embodiment are generally not limited to that particular embodiment, but, where applicable, are interchangeable and can be used in a selected embodiment, even if not specifically shown or described. The same may also be varied in many ways. Such variations are not to be regarded as a departure from the disclosure, and all such modifications are intended to be included within the scope of the disclosure.

What is claimed is:

1. A method of manufacturing a mattress, comprising:

forming a mattress inner core;

forming a non-quilted mattress cover; and attaching the non-quilted mattress cover to the inner core without sewing;

wherein the non-quilted mattress cover is formed of a laminate including a polymeric non-woven fabric outer layer that is embossed, and the laminate is cut to include a cover top panel and a plurality of cover side panels that are unitary with and extend outward from the cover top panel; and wherein the step of attaching the non-quilted mattress cover to the inner core without sewing includes orthogonally orienting the cover side panels relative to the cover top panel and fusing portions of adjoining surfaces of adjacent cover side panels to each other to form a coffin, inserting the mattress inner core into the coffin, folding non-fused portions of the adjoining surfaces of the adjacent cover side panels over the mattress inner core, and bonding a bottom panel to the non-fused portions of the cover side panels and the mattress inner core.

2. The method of claim 1, wherein the mattress inner core is formed from least one layer of polymeric nonwoven fiber.

3. The method of claim 1, wherein mattress inner core is formed from a plurality of layers of polymeric nonwoven fiber, and each of the plurality of layers include a different density of the nonwoven fibers to adjust a stiffness of the mattress inner core.

4. The method of claim 3, wherein the plurality of layers of polymeric nonwoven fiber are stacked on top of each other.

5. The method of claim 3, wherein the plurality of layers of polymeric nonwoven fiber are stacked side-by-side relative to each other.

6. The method of claim 1, further comprising adhering a rail assembly to the mattress inner core about a perimeter of the mattress inner core.

7. The method of claim 6, further comprising adjusting a stiffness of the rail assembly by applying a rigid coating to the rail assembly.

8. The method of claim 1, wherein the polymeric nonwoven fabric outer layer is formed of a recyclable polymeric material.

9. The method of claim 8, wherein the recyclable polymeric material is at least one of polyester and polyethylene.

10. The method of claim 1, wherein the laminate includes a fiber layer.

11. The method of claim 10, wherein the fiber layer is fire-retardant.

12. The method of claim 1, wherein the portions of the adjoining surfaces of the adjacent cover side panels are fused to each other using RF or ultrasonic welding.

13. The method of claim 1, wherein the polymeric nonwoven fabric outer layer of the laminate is embossed by heated stamping.

14. A mattress, comprising:

a mattress inner core;

a non-quilted mattress cover that is attached to the mattress inner core without sewing; and a bottom panel attached to the inner core and non-quilted mattress cover without sewing, wherein the non-quilted mattress cover is formed of a laminate including a polymeric non-woven fabric outer layer that is embossed, and the laminate includes a cover top panel and a plurality of cover side panels that are unitary with and extend outward from the cover top panel;

the cover side panels are orthogonally oriented relative to the top panel, and adjoining surfaces of adjacent cover side panels include fused portions that are fused together and surround the mattress inner core, and non-fused portions that are not fused together and are folded over the mattress inner core; and the bottom panel is adhered to the non-fused portions folded over the mattress inner core and to the mattress inner core.

15. The mattress of claim 14, wherein the mattress inner core is formed from least one layer of polymeric nonwoven fiber.

16. The mattress of claim 14, wherein the mattress inner core is formed from a plurality of layers of polymeric nonwoven fiber, and each of the plurality of layers include a different density of the nonwoven fibers to adjust a stiffness of the mattress inner core.

17. The mattress of claim 16, wherein the plurality of layers of polymeric nonwoven fiber are stacked on top of each other.

18. The mattress of claim 16, wherein the plurality of layers of polymeric nonwoven fiber are stacked side-by-side relative to each other.

19. The mattress of claim 14, further comprising a rail assembly adhered to the mattress inner core about a perimeter of the mattress inner core.

20. The mattress of claim 19, wherein the rail assembly includes a rigid coating.

21. The mattress of claim 14, wherein the polymeric non-woven fabric outer layer is formed of a recyclable polymeric material.

22. The mattress of claim 21, wherein the recyclable polymeric material is at least one of polyester and polyethylene.

23. The mattress of claim 14, wherein the laminate includes a fiber layer.

24. The mattress of claim 23, wherein the fiber layer is fire-retardant.

25. A method of manufacturing a non-quilted mattress cover, comprising:

forming a laminate including a plurality of layers, the plurality of layers including a polymeric non-woven fabric outer layer;

embossing the polymeric non-woven fabric outer layer and cutting the laminate such that the laminate includes a cover top panel and a plurality of cover side panels that are unitary with and extend outward from the cover top panel;

orthogonally orienting the cover side panels relative to the cover top panel and connecting adjoining surfaces of adjacent cover side panels to each other, wherein the adjoining surfaces of the adjacent cover side panels are connected in a manner to form connected sections where portions of the adjoining surfaces of the adjacent cover side panels are attached to each other and form non-connected sections where portions of the adjoining surfaces of the adjacent cover side panels are not connected to each other; and providing a bottom panel that is configured to be attached to the non-connected sections, wherein the connected sections collectively define a volume configured for receipt of a mattress inner core, and the non-connected sections are configured to be folded over the mattress inner core and configured to be attached to the bottom panel.

26. A non-quilted mattress cover manufactured according to the method of claim 25.

27. The non-quilted mattress cover according to claim 26, wherein the non-quilted mattress cover is recyclable.

* * * * *